United States Patent [19]

Judkins

[11] 4,131,276

[45] Dec. 26, 1978

[54] NON-INJURIOUS AMUSEMENT BALL AND METHOD OF MAKING SAME

[76] Inventor: Ren Judkins, 2260 Belaire Dr., Salt Lake City, Utah 84109

[21] Appl. No.: 836,630

[22] Filed: Sep. 26, 1977

[51] Int. Cl.[2] ..... A63B 43/02; A63B 45/00; A63B 37/14

[52] U.S. Cl. ..... 273/58 C; 273/58 K; 273/DIG. 20; 273/DIG. 8

[58] Field of Search ..... 273/199 R, 199 A, 58 K, 273/200 R, DIG. 20, DIG. 8; 15/244 C; 428/4, 5

[56] References Cited

U.S. PATENT DOCUMENTS

| | | | |
|---|---|---|---|
| 646,350 | 3/1900 | Breinl | 273/58 A |
| 1,548,531 | 8/1925 | Knight | 273/199 R UX |
| 1,611,076 | 12/1926 | Rittner | 273/200 R |
| 2,450,474 | 10/1948 | Grobner | 273/199 R UX |
| 2,789,305 | 4/1957 | Weil | 15/244 R |
| 3,069,170 | 12/1962 | Dillon | 273/199 R |

FOREIGN PATENT DOCUMENTS

| | | | |
|---|---|---|---|
| 483502 | 5/1952 | Canada | 273/58 K |
| 963098 | 5/1957 | Fed. Rep. of Germany | 15/244 R |
| 16231 of | 1910 | United Kingdom | 273/199 A |

*Primary Examiner*—George J. Marlo
*Attorney, Agent, or Firm*—H. Ross Workman; J. Winslow Young

[57] ABSTRACT

A lightweight, non-injurious amusement ball designed for use in a restricted area or where it is desirable to prevent injury to the surroundings and participants from impact with the ball. The ball is fabricated from resilient, cellular plastic foam strips of rectangular cross section compressed in a central core and extending radially into an essentially spherical periphery. The periphery is impact absorbent and wind resistant for non-injurious activity and limited flight. A core is used to tie and compress the strips in the central core, providing increased density for stable trajectory.

7 Claims, 3 Drawing Figures

NON-INJURIOUS AMUSEMENT BALL AND METHOD OF MAKING SAME

BACKGROUND

Field of the Invention

The present invention relates to devices or toys for sports and amusement such as play balls and practice balls, and more particularly to balls designed for limited trajectory for use in a restricted area and where it is desirable to prevent injury to the surroundings and the participants from impact with the ball.

The Prior Art

Sports of all types have become an increasingly integral part of modern living. Adult men and women are recognizing the importance of regular exercise and physical activity in the maintenance of good health and wholesome living. Many people can be seen jogging, cycling, playing handball and the like. This activity has increased substantially in recent years, and is a significant factor in the overall improvement in the health and vitality of those involved in such activity.

Many jobs and occupations are characterized by physical non-activity. Automation and work-saving devices have absorbed most of the actual physical work in our society. A large percentage of men and women are engaged in occupations in which the amount of physical exertion involved is extremely limited. These conditions have led to the increased interest and enthusiasm in sports activities. However, it is difficult for many people in large cities and many other areas to find and acquire the use of adequate facilities for many of the popular sports activities.

Children and youth are often similarly restricted in their opportunities for wholesome physical activity which is important for the growth, development, and health of their bodies. Such activity is highly desirable for children to develop character and sportsmanship and to provide them with a wholesome diversion.

In confined areas, it is impossible for both children and adults to play using regulation sports equipment without the risk that a window will be broken or some other injury to the surroundings will result. It is also difficult in such circumstances to maintain the proper freedom of movement to protect oneself from injury when using regulation sports equipment. This is especially true for smaller children. Parents often refrain from letting their young children engage in such activity for this reason.

In such small areas, it is also difficult to keep a softball, football, or other regulation sports ball within the confined area. Many balls as a result are lost or injure a neighbor's property. Sports equipment is needed which will be suitable for play in such restricted areas. Such equipment should be adaptable for use in a variety of games and occasions. It should be safe for small children to use and safe for the surroundings of an enclosed area. Such equipment should also be exciting for older children and adults and provide them with the opportunity for wholesome exercise. Family fun, amusement, and child diversion should be provided by such equipment without the necessity of requiring a large playing area.

Practice balls and play balls designed for non-injurious play in restricted areas are well known in the prior art. Simple homogenous plastic foam balls and hollow balls with solid plastic shells in spherical or football shapes are common. Also, hollow plastic balls with holes for increased air resistance are well known. These lightweight, substantially non-injurious balls are adapted for use in restricted areas and for use wherein it is desirable to protect the participants and the surroundings from injury. Due to the lightweight and air resistance of these balls, a limited trajectory is achieved from throwing or other impetus. The light weight of the balls, and particularly the cushioning of any foam material, prevent injury. However, certain drawbacks and inefficiencies are apparent in the use of these balls. For example, a true trajectory is seldom obtained from a throw or propulsion by striking. Due to the lack of adequate density in and around the center of gravity in the balls, insufficient momentum is maintained by the ball during trajectory to counteract the air resistance of the ball and the variable wind currents, often resulting in a hyper-shortened, erratic flight.

Additionally, it is often overly difficult to catch balls of this type. As a participant attempts to grab or capture a ball of this type with his hands and fingers, the ball reacts and rebounds to the relatively small force placed upon it by the hands and fingers, often bouncing away therefrom. This is again due to the lack of an adequate density in and around the center of gravity and the resulting low momentum maintained by these balls during flight and as they enter the participant's hands. For these reasons, balls of this type are not an effective replication of baseballs, softballs, or footballs. Neither are they effective in generating consistent, well-ordered play action.

Also known in the art are balls which are typically heavier and less safe for use in a restricted area or for non-injurious activity. Such balls include rubber balls, hard rubber balls, and balls made from dense plastic foam. These balls are usually a more realistic replication of baseballs, softballs, and footballs than are the balls of the lighter, non-injurious type. A more true, stable trajectory is usually obtained in the use of the heavier balls, and they are relatively easy to catch.

However, the heavier balls are not adapted for use in a restricted area, having a greater overall density and decreased wind resistance. A significantly longer trajectory than that of the lighter balls from a similar impetus is achieved using the heavier balls. Though some balls of this type are relatively soft and shock absorbent, most are somewhat hard and capable of imparting a substantial impact shock upon striking a participant or an object of the surroundings.

A ball is needed that will combine the relative lightweight, the shock absorbent properties, and the short-range trajectory of the lighter balls with the stable trajectory, the ease of catching and the overall replication of the heavier balls. Such a ball should have an adequate density in and around the center of gravity for a true flight and ease of catching. Such a ball should at the same time have cushioning, air resistant material in the periphery of the ball to absorb shock and restrict trajectory length. A variety of games and types of diversion should be provided by such a ball wherein family fun and wholesome physical activity would be a result. Such a ball is disclosed in the present invention.

BRIEF SUMMARY AND OBJECTS OF THE INVENTION

The present invention comprises a novel play ball for use in a restricted area or where it is desirable to protect the surroundings and the participants from injury while using the ball. The invention combines adequate density at the center of gravity of the ball for a true trajectory and ease of catching with an air resistant, shock absorbent periphery for limited flight and non-injurious activity. The ball is constructed of a plurality of resilient cellular foam strips projecting from the core of the ball into the periphery. The strip projections aid in making the ball easy to catch and handle.

It is, therefore, a primary object of the present invention to provide a novel play ball which is shock absorbent for non-injurious activity and method of constructing same.

It is another object of the present invention to provide a play ball which has an air resistant periphery for limiting flight.

It is another object of the present invention to provide a play ball which has adequate density in the center of gravity to make it easy to catch and aid in maintaining a true trajectory during flight.

It is another object of the present invention to provide a ball that has resilient cellular foam strips projecting from the core of the ball into the periphery to aid in making the ball easy to catch and handle.

It is another object of the present invention to provide a ball made of foam plastic or rubber that is bound in such a way that a tether may be securely attached and that forces imparted by the tether to the foam are well distributed for better durability.

These and other objects and features of the present invention will become more fully apparent from the following description and appended claims taken in conjunction with the accompanying drawing.

DETAILED DESCRIPTION OF THE PREFERRED EMBODIMENT

Figure 1:
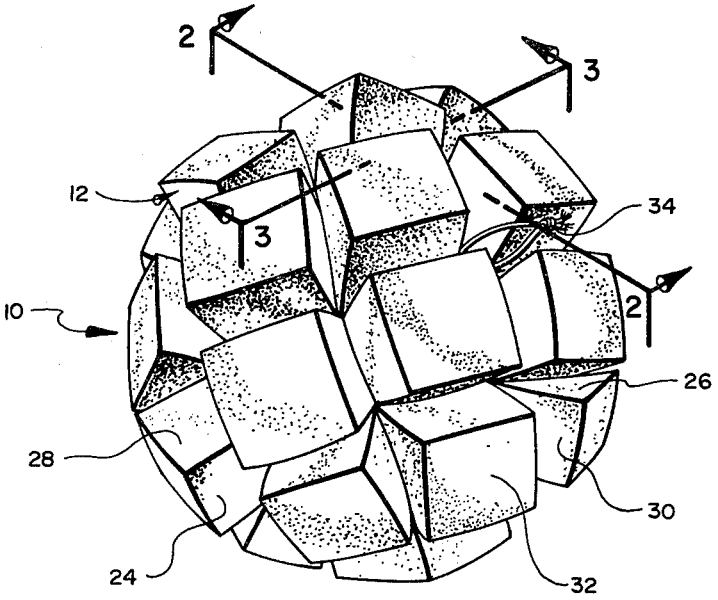
FIG. 1 is a perspective view of a presently preferred embodiment of the play ball.

Attention is now directed to the drawing wherein like numerals represent like parts throughout. In the figures, one presently preferred embodiment of the play ball generally designated 10 is illustrated. In the presently preferred embodiment, play ball 10 is of essentially spherical configuration.

Figure 2:
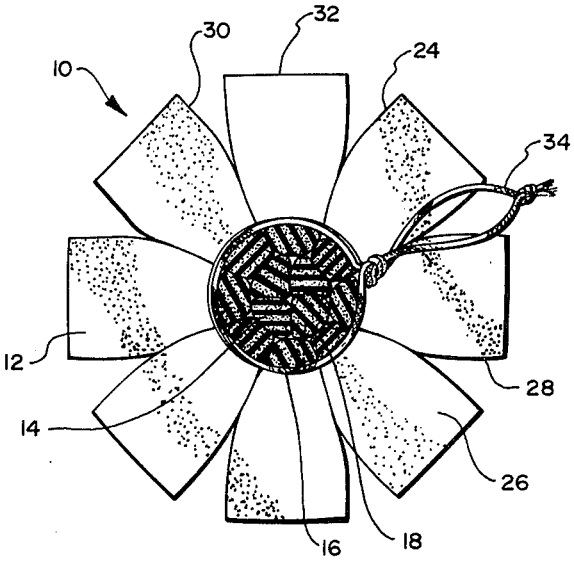
FIG. 2 is a cross section of the embodiment of FIG. 1 taken along line 2—2.

Referring particularly to FIG. 2, play ball 10 is composed of a plurality of strips generally designated 12. In the presently preferred embodiment, strips 12 are preferably of varying length and uniform rectangular cross section. An array of twelve strips designated 12 is used in the presently preferred embodiment. This number has been found to be suitable for the formation of a spherical ball, as will be hereinafter more fully described. Strips 12 are preferably constructed of a resilient, flexible plastic foam material such as polyurethane or other suitable synthetic polymeric material. A process is used to produce the foam which results in the material taking a cellular, fibrous configuration. This results in a plurality of tiny surficially and volumetrically interstitial apertures (not shown). These apertures pervade throughout the foam and are of fairly uniform size and spacing. The resulting foam is light in weight and has a high degree of wind resistance and excellent cushioning characteristics, as will be hereinafter more fully described.

Figure 3:
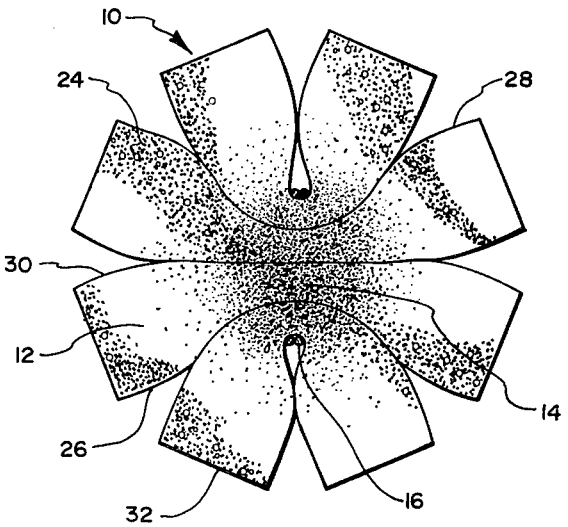
FIG. 3 is a cross section of the embodiment of FIG. 1 taken along line 3—3.

With continued reference to FIG. 2, strips 12 are centrally bent at centers 14. The centers 14 of strips 12 are bent at angles varying with the positioning of the strips 12 with respect to the axis of the play ball 10 represented by line 2—2 in FIG. 1. For example, strips 12 whose centers 14 are positioned radially farthest away from the axis of play ball 10 represented by line 2—2 have centers 14 which are most acutely bent (see FIG. 3). Centers 14 positioned radially more closely to line 2—2 are correspondingly less acutely bent. Generally, those strips 12 which are most acutely bent, i.e. in direct contact with cord 16, have a shorter length than those in the core (as shown in FIG. 2). Thus, when assembled, the ends of the strips 12 present a generally spherical configuration. Alternatively, the respective lengths of strips 12 may be selectively altered to present a ball of any desirable configuration.

The bending angles and positioning of centers 14 are maintained by means of a cord 16. Cord 16 is preferably a small rope, strap or other suitable binding material. In order to maintain such angles and positioning of centers 14, cord 16 is tied in circular configuration tightly around centers 14. Cord 16 thus imposes a restraining force acting on strips 12 in a radially inward direction, causing strips 12 to be significantly compressed within the region around centers 14. The compression of the centers results in a central core 18 which has a relatively high density compared to the overall volume of the ball. The compression imposed on strips 12 by cord 16 forces strips 12 against each other at centers 14 and in central core 18. Strips 12 exert in opposition to the radially inward force imposed by cord 16 a compression resistive force. This resistive force is apparent throughout central core 18. This force is imparted through central core 18 on the portions of strips 12 therewithin in increasing intensity from the center of ball 10 to the periphery of central core 18. The increasing intensity of this force and limitations of available space results in the increasing acuteness of the bending angles of centers 14.

In the illustrated embodiment, a tether 34 is secured to the core 18 of play ball 10. Preferably, tether 34 is an extension of the cord 16 as will be hereinafter more particularly described.

Central core 18 provides adequate density for enabling a true flight and means of catching and handling play ball 10. This is accomplished by the compression of strips 12 within central core 18. The plastic foam material, in a compressed condition, is characterized by the polymeric material assuming a close-packed configuration, partially collapsing the interstitial apertures at the core 18. The close-packed configuration is significantly more dense than the non-compressed foam. The density thus achieved in the central core 18 provides efficient momentum during flight to stabilize trajectory in opposition to the air resistance of the ball and variable wind currents. This density also facilitates easy catching and handling of the ball.

Arms 24 of strips 12 extend radially outward from central core 18 and are substantially uniformly dispersed in the essentially spherical periphery of play ball 10. Surfaces 28 of strips 12 are exposed outward from central core 18 on arms 24. Surfaces 28 define interradial spaces (e.g. at 30--see especially FIG. 2.), which are substantially uniformly dispersed around the periphery. Spaces 30 provide a high degree of air exposure of surfaces 28 during trajectory of play ball 10. Ends 32 of strips 12 are of rectangular configuration and generally perpendicular to surfaces 28. Ends 32 collectively define the spherical periphery of play ball 10.

Arms 24 and ends 32 of strips 12 provide an effective cushioning periphery for play ball 10. The flexible plastic foam is sufficiently soft so as to be safe for use with small children and in restricted areas. Even a very high velocity impact with play ball 10 will be relatively harmless to very young children and delicate surroundings. Arms 24 and ends 32 also sufficiently project outwardly from central core 18 so as to facilitate ease of catching and grasping of the play ball 10 at arms 24. The combination of the density of the central core 18 and the projection of arms 24 facilitates the catching and handling of play ball 10.

During trajectory of play ball 10, surfaces 28 of strips 12 are exposed and pass through the surrounding air. Air is compressed within the interradial spaces 30 and forced alternatively in, through, and out of the spaces 30. This motion of air around and into spaces 30 as well as the wind resistance of the surfaces 28 creates a sufficient amount of localized air turbulence and resulting wind resistance which stabilizes and limits trajectory of the projectile and assists in reshaping the play ball after impact. The maximum exposure to the air of surfaces 28 provided by spaces 30 results in a structure having a high degree of wind resistance and which is well adapted for use in a limited area.

Play ball 10 may thus be used as a practice ball or play ball for sports such as soccer, baseball, volley ball, basketball, or other similar sportive activity. Play ball 10 will provide a high degree of replication to the corresponding regulation sports equipment, while being highly suitable for use in a restricted area or for use with small children.

Attention is again directed to FIG. 2. FIG. 2 illustrates tether 34 secured to cord 16. Tether 34 is optionally attached to permit use of the play ball 10 as a tether ball or the like and, if desired, tether 34 may be elongated as required for use. Attachment of the tether 34 to the play ball 10 at core 18 uniquely permits the play ball to be used in conventional fashion without interference from the tether 34 while simultaneously permitting attachment of the ball by the tether whenever desired.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An amusement ball comprising:

a first plurality of resilient cellular foam strips each having an essentially uniform first length;

a second plurality of resilient cellular foam strips each having an essentially uniform second length that is shorter than said first length, said second foam strips being placed so as to essentially surround said first plurality of foam strips; and a band placed around the middle of said first and second foam strips, said band being sufficiently tightened to cause said foam strips to be tightly gathered about their middle, thus forming a compact resilient core essentially enclosed by said foam strips, and said foam strips being bent to form an essentially spherical configuration.

2. An amusement ball as defined in claim 1 wherein said foam strips are of essentially uniform cross sectional area.

3. An amusement ball as defined in claim 2 wherein said cross sectional area of each said foam strip is sufficiently large as to necessitate that the length of said second foam strips be shorter than the length of said first foam strips in order to insure that said first and second foam strips will present an essentially spherical configuration when tightly gathered about their middle.

4. An amusement ball as defined in claim 1 wherein said foam strips define a plurality of interradial spaces.

5. An amusement ball as defined in claim 1 wherein said band further comprises a tether attached to said band, said tether having sufficient length so as to be easily accessible between said foam strips.

6. A method of fabricating an amusement ball having an essentially spherical configuration, the method comprising the steps of:

obtaining a first plurality of plastic cellular foam strips each having an essentially uniform first length;

obtaining a second plurality of plastic cellular foam strips each having an essentially uniform second length that is shorter than said first length;

surrounding said first plurality of foam strips with said second foam strips; and tightly binding said first and second foam strips about their middle so as to cause said foam strips to be tightly gathered, thus forming a compact, resilient core essentially enclosed by said foam strips while at the same time causing said foam strips to bend, thereby forming an essentially spherical configuration.

7. A method as defined in claim 6 further comprising the steps of obtaining a tether and securing said tether to said core of the amusement ball.

* * * * *